US011817668B2

(12) United States Patent
Benn

(10) Patent No.: US 11,817,668 B2
(45) Date of Patent: Nov. 14, 2023

(54) PASSIVE TWO-PIECE INNER CONDUCTOR FOR COMPRESSION CONNECTOR

(71) Applicant: John Mezzalingua Associates, LLC, Liverpool, NY (US)

(72) Inventor: Jeremy Benn, Liverpool, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 17/623,837

(22) PCT Filed: Jul. 29, 2020

(86) PCT No.: PCT/US2020/044052

§ 371 (c)(1),
(2) Date: Dec. 29, 2021

(87) PCT Pub. No.: WO2021/021921

PCT Pub. Date: Feb. 4, 2021

(65) Prior Publication Data

US 2022/0247100 A1 Aug. 4, 2022

Related U.S. Application Data

(60) Provisional application No. 62/879,748, filed on Jul. 29, 2019.

(51) Int. Cl.
*H01R 9/05* (2006.01)
*H01R 13/52* (2006.01)
(Continued)

(52) U.S. Cl.
CPC ..... *H01R 9/0518* (2013.01); *H01R 13/52* (2013.01); *H01R 13/6476* (2013.01); *H01R 24/564* (2013.01); *H01R 2103/00* (2013.01)

(58) Field of Classification Search
CPC ..... H01R 24/44; H01R 13/502; H01R 13/40; H01R 13/02; H01R 2103/00; H01R 24/564; H01R 13/6476
See application file for complete search history.

(56) References Cited

U.S. PATENT DOCUMENTS

2007/0042642 A1 2/2007 Montena et al.
2013/0244484 A1 9/2013 Wild et al.
2018/0226757 A1* 8/2018 Urtz, Jr. ..... H01R 13/5213

FOREIGN PATENT DOCUMENTS

CN 208106623 U * 11/2018
CN 109473800 A 3/2019
(Continued)

OTHER PUBLICATIONS

International Searching Authority, International Search Report and Written Opinion, dated Nov. 9, 2020, (10 pages).
(Continued)

*Primary Examiner* — Jean F Duverne
(74) *Attorney, Agent, or Firm* — Barclay Damon LLP

(57) ABSTRACT

A compression connector comprises a connector body comprising an inner surface and a threaded clamp at least partially positioned within the connector body and configured to slide relative to the connector body. A contact cone is positioned within the connector body and comprises an outer surface configured to engage with the inner surface of the connector body. An insulator is positioned proximate the contact cone and defines an aperture. An inner conductor comprises a contact component comprising an inner conductor basket and a cylindrical portion extending from the conductor basket, and an interface component defining an opening configured to engage with the cylindrical portion of the contact component. The contact component, the interface component, and the insulator are held together such that
(Continued)

they form a rigid three-piece assembly when the threaded clamp couples an end of a cable.

19 Claims, 4 Drawing Sheets

(51) Int. Cl.
*H01R 13/6476* (2011.01)
*H01R 24/56* (2011.01)
*H01R 103/00* (2006.01)

(56) References Cited

FOREIGN PATENT DOCUMENTS

| | | | |
|---|---|---|---|
| FR | 1050867 | A | 1/1954 |
| FR | 64008 | E | 10/1955 |
| KR | 1020180078662 | A | 7/2018 |

OTHER PUBLICATIONS

International Preliminary Examing Authority, International Preliminary Report on Patentability, dated Oct. 27, 2021 (5 pages).
European Patent Office; Extended European Search Report; Application No. 20846702.7; dated Jul. 17, 2023; Search completed: Jul. 5, 2023; 11 pages.

* cited by examiner

PASSIVE TWO-PIECE INNER CONDUCTOR FOR COMPRESSION CONNECTOR

CROSS-REFERENCE TO RELATED APPLICATIONS

This application is a national stage application pursuant to 35 U.S.C. § 371 of International Application No. PCT/US20/44052, filed on Jul. 29, 2020, which claims priority to, and the benefit of U.S. Provisional Patent Application No. 62/879,748, filed on Jul. 29, 2019. The entire contents of such applications are hereby incorporated by reference.

FIELD OF INVENTION

The present invention relates to wireless communications, and more particularly, to a simple yet highly reliable compression connector for an RF cable or jumper that comprises a two-piece inner conductor.

BACKGROUND

Compression connectors provide an extremely reliable connection that prevents Passive Intermodulation Distortion (PIM) while providing for an easy installation process. Conventional compression connectors have a basket-like inner conductor receptacle that has fingers that actively engage the cable's inner conductor during the compression process. Although this is effective in forming a reliable connection, it requires considerable mechanical infrastructure within the connector to effect the connection. The additional mechanical infrastructure increases the complexity, cost, and materials required to produce the compression connector.

These are just some of the disadvantages associated with compression connectors currently in use.

SUMMARY

An aspect of the present invention involves a compression connector for an RF cable. The compression connector comprises a connector body having an inner surface; a threaded clamp configured to translate within the connector body; a contact cone having an outer surface that engages with the inner surface of the connector body; an insulator disposed within the connector body, the insulator having a disk shape with an outer surface that engages with the inner surface of the connector body, and a rear face that engages with a forward face of the contact cone, the insulator further having an aperture disposed at the center of the disk shape; and a two piece inner conductor, the two piece inner conductor having an interface component and a contact component, wherein the contact component has a passive inner conductor basket and a cylindrical portion disposed within the aperture of the insulator, and wherein the interface component has an opening that engages with the cylindrical portion of the contact component, and wherein the two piece inner conductor forms a slot that holds the two piece inner conductor in rigid contact with the insulator.

In an embodiment, a compression connector comprises a connector body having a first end and an opposing second end and comprising an inner surface and a threaded clamp located proximate the second end. The threaded clamp is at least partially positioned within the connector body and configured to slide relative to the connector body. A contact cone is positioned within the connector body in a direction towards the first end relative to the threaded clamp. The contact cone comprises an outer surface configured to engage with the inner surface of the connector body. An insulator configured to contact the inner surface of the connector body is positioned proximate the contact cone and defines an aperture. An inner conductor comprises a contact component and an interface component. The contact component comprises an inner conductor basket and a cylindrical portion extending from the conductor basket that is at least partially positioned within the aperture of the insulator. The interface component defines an opening configured to engage the cylindrical portion of the contact component. When a cable is installed at the second end of the connector body, the contact component, the interface component, and the insulator are held together such that they form a rigid three-piece assembly.

BRIEF DESCRIPTION OF THE DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION

The following discussion relates to various embodiments of a passive, two-piece inner conductor for a compression connector. It will be understood that the herein described versions are examples that embody certain inventive concepts. To that end, other variations and modifications will be readily apparent to those of sufficient skill in the field. In addition, a number of terms are used throughout this discussion in order to provide a suitable frame of reference with regard to the accompanying drawings. These terms such as "forward", "rearward", "rear", "inner", "outer", and the like are not limited to these concepts, except where so specifically indicated. In addition, the drawings are intended to depict salient features of the inventive device for use in a compression connector. Accordingly, the drawings are not specifically provided to scale and should not be relied upon for scaling purposes.

Figure 1:
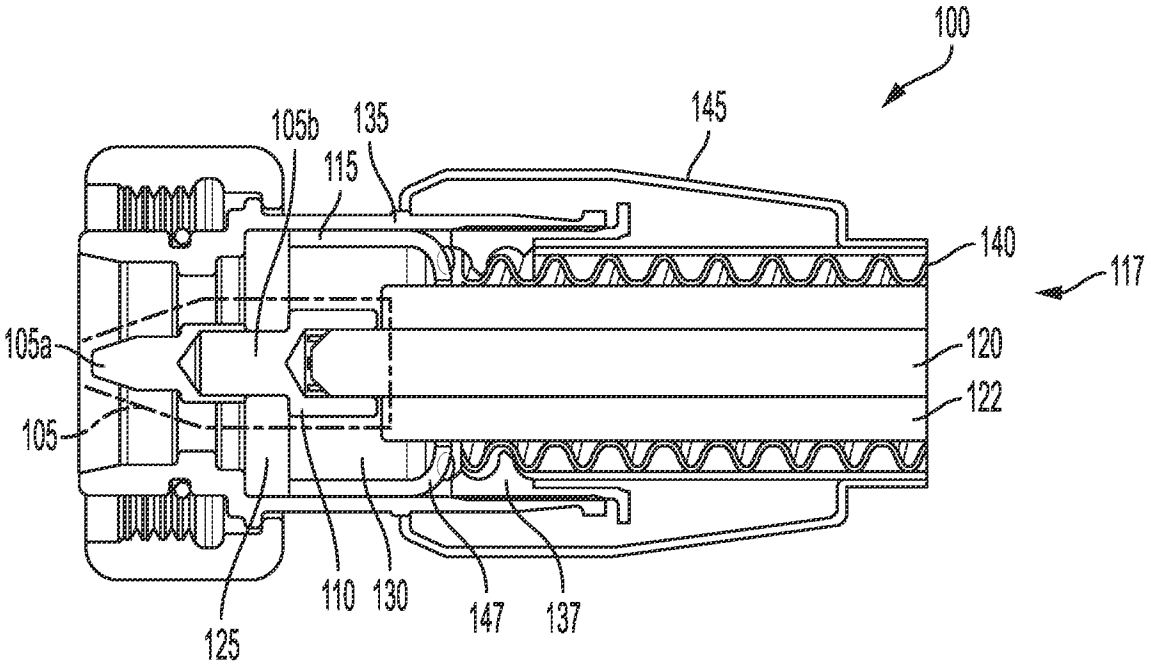
FIG. 1 illustrates an exemplary compression connector according to the disclosure.

FIG. 1 illustrates an embodiment of a compression connector 100 according to the disclosure generally comprising a connector body 135 at least partially surrounding a two-piece inner conductor 105. The two-piece inner conductor comprises an interface component 105*a* and a contact component 105*b* that includes an inner conductor basket 110.

The interface component 105*a* and the contact component 105*b* both engage an insulator 125, which is held rigidly in place between the connector body 135 and a contact cone 115. An air gap 130 is defined between the insulator 125, the contact component 105*b*, and the contact cone 115. The dimensions of air gap 130 and the thickness of contact cone 115 are configured so that a 50 ohm impedance is achieved by connector 100. As illustrated in FIG. 1, the connector 100 is installed on an embodiment of a cable 117, which includes an inner cable conductor 120, a dielectric 122, and a corrugated outer conductor 140. In an embodiment, the cable 117 may be a standard 12-S 0.5" Superflex RF cable.

Still referring to FIG. 1, the inner cable conductor 120 is engaged with the conductor basket 110 of the contact component 105*b* of the two-piece inner conductor 105 and forms a solid and secure connection between inner cable conductor 120 and the interface component 105*a*. This connection is formed by dimensioning the inner conductor basket 110 to provide a fit that is secured by friction between the inner surface of the inner conductor basket 110—aided by one or more cuts or slots 150 (FIG. 2) formed in the inner surface of conductor basket 110—and the outer surface of the inner cable conductor 120. In an embodiment, the one or more slots enable the inner conductor basket 110 to flex in response to the insertion of the inner cable conductor 120. Once the inner cable conductor 120 is inserted into the inner conductor basket 110, the inner conductor basket 110 may act to exert a radial force on the inner cable conductor 120 that is directed towards the interior of the inner conductor basket 110 to secure the inner cable conductor 120. Insertion of the inner cable conductor 120 into the inner conductor basket 110 may further act to secure the interface component 105*a*, the contact component 105*b*, and in insulator 125 such that they form a rigid three-piece assembly. In another embodiment, the rigid three-piece assembly may be formed prior to the insertion of the inner cable conductor 120 into the inner conductor basket 110. Unlike a conventional compression connector, there is no inner mechanism for providing pressure around the inner conductor basket 110. Instead, the design and dimensions of the contact component 105*b*, the inner conductor basket 110, and how the two-piece inner conductor 105 is held rigidly with insulator 125, collectively provide for a passive but firm contact. The advantage of this approach is that the connector 100 is much simpler to assemble and has fewer components than a convention compression connector.

The reliability of the connection between the inner cable conductor 120, the contact component 105*b*, and the interface component 105*a* is further assured by the rigidity of the combination of the contact component 105*b*, the interface component 105*a*, the insulator 125, and the contact cone 115. The rigidity is formed or established after installation of cable 117 onto the connector 100, in which a manual or pneumatic press may be used to apply a force to the outer surface of clamp 137 in a direction toward the contact cone 115. The resulting translation of the clamp 137 causes the corrugated outer conductor 140 of the cable 117 to fold at interface 147. The force further results in the contact cone 115 applying pressure on insulator 125.

Rigidity is maintained by a press fit formed by interface component 105*a* and contact component 105*b* around insulator 125, forming a rigid three-piece assembly between these three components. A frictional press fit between contact component 105*b* and interface component 105*a* further maintains the rigidity of this three-piece assembly. Additionally, frictional contact (press fit) between the contact cone 115 and the connector body 135 inhibits the insulator 125 from shifting around after installation of the cable 117 onto the connector 100.

Also illustrated in FIG. 1 is overmolded strain relief component 145, disposed around connector 100 and cable 117, encapsulating threaded clamp 137. In an embodiment, the overmolded strain relief component 145 may be comprised of a rigid thermoplastic.

Figure 2:
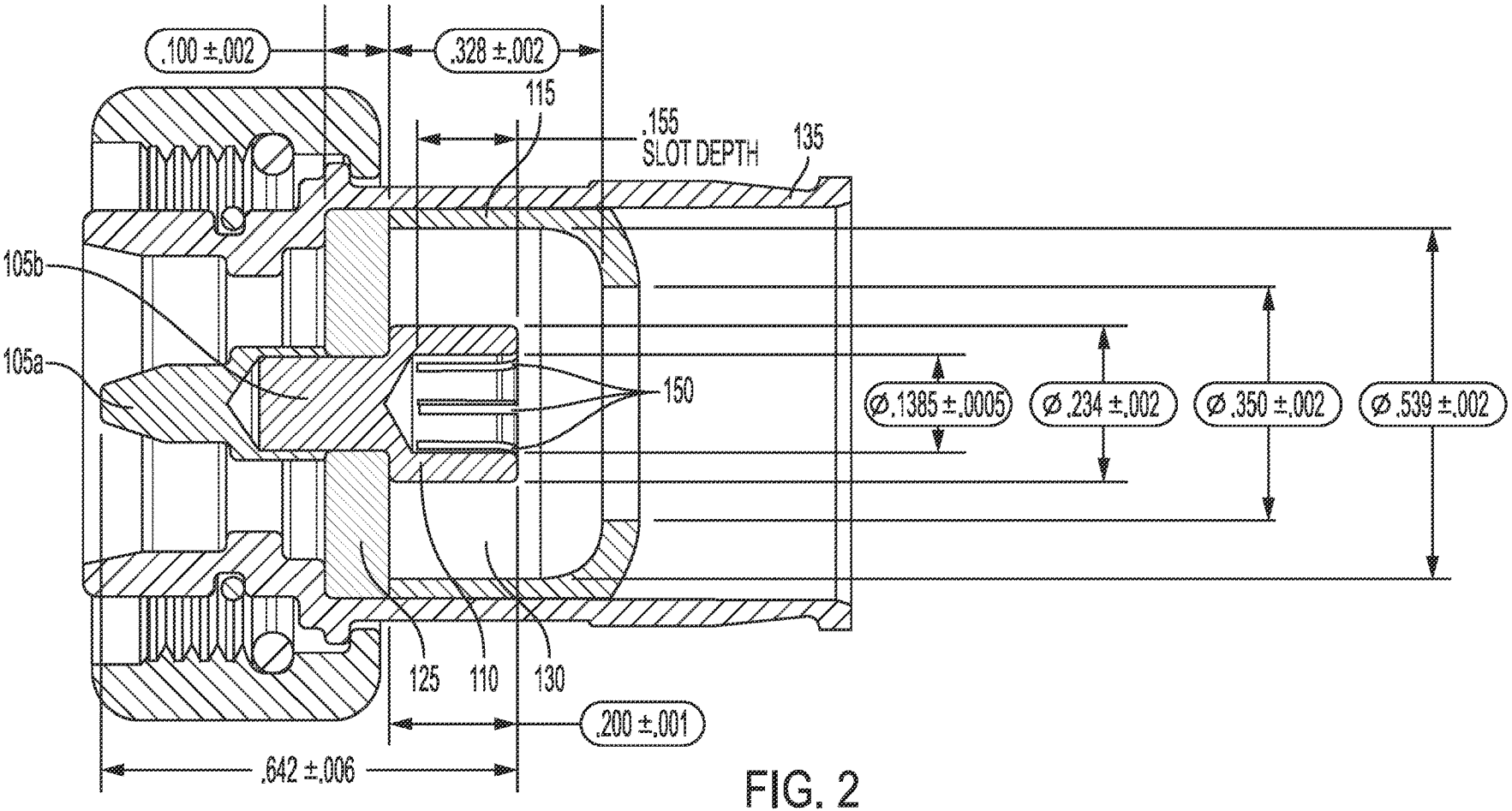
FIG. 2 further illustrates the exemplary compression connector of FIG. 1, including exemplary dimensions.

Referring to FIG. 2, an embodiment of the compression connector 100 is shown without cable 117, providing examples of ranges of dimensions and tolerances of several of the connector 100 components. Further illustrated in FIG. 2 are the saw cuts 150 disposed on the inner surface of inner conductor basket 110. In an embodiment, the contact component 105*b*, including inner conductor basket 110, may be formed of silver plated brass; and the interface component 105*a* may be formed of tri-metal plated brass.

Figure 3:
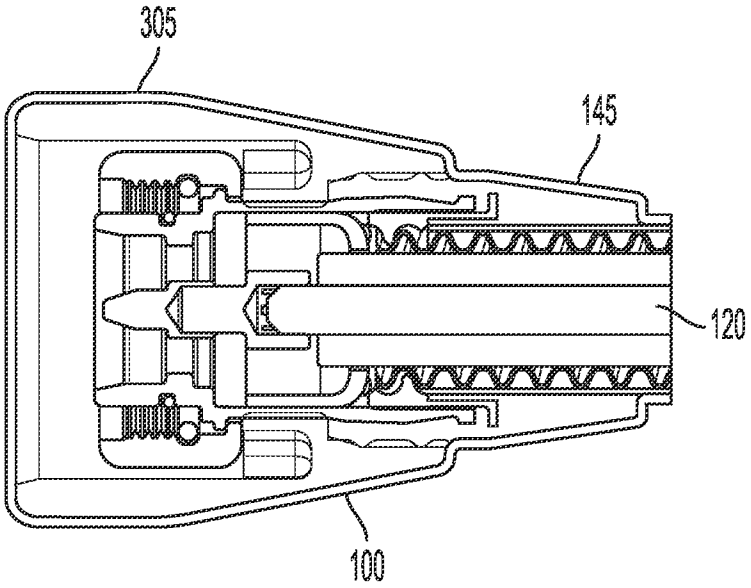
FIG. 3 illustrates the compression connector of FIG. 1, with a Weather Protection System (WPS) boot installed and engaged with the connector's overmolded strain relief.

FIG. 3 illustrates an embodiment of the connector 100 with a weather protection boot (such as a WPS boot) 305 inserted over and forming a seal with the connector body 135 of the connector 100 and the overmolded strain relief 145.

Figure 4A:
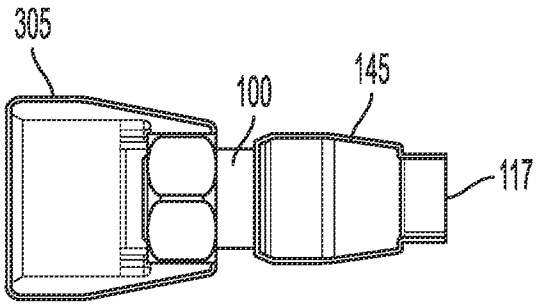
FIGS. 4A and 4B illustrate an exemplary compression connector with one example of a WPS boot engaged with the connector's overmolded strain relief, before and after engaging.
Figure 4B:
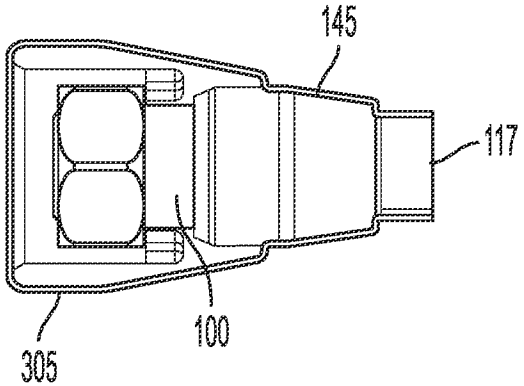

FIGS. 4A and 4B illustrate the insertion of the weather protection boot 305 over a pre-assembled connector 100 that is already installed on cable 117. FIG. 4A illustrates the first step of the process for installing the weather protection boot 305; and FIG. 4B illustrates the weather protection boot 305 after installation on connector 100. As shown in FIG. 4B, once installed, the weather protection boot 305 forms a seal on the connector body and the overmolded strain relief 145.

Figure 5A:
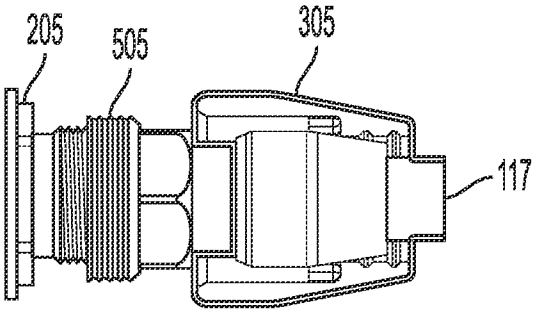
FIGS. 5A and 5B illustrate an exemplary compression connector with a WPS boot being installed over a port seal.
Figure 5B:
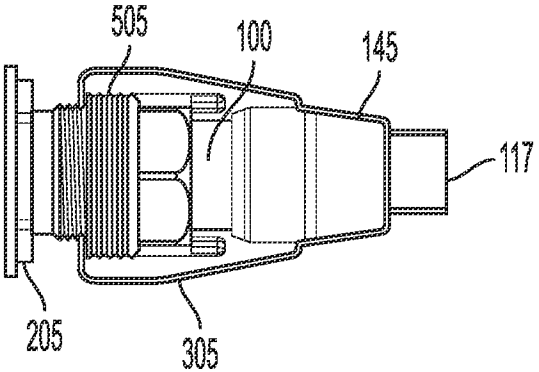

FIGS. 5A and 5B illustrate the compression connector 100 with the weather protection boot 305 being installed over a port 205 and port seal 505.

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements, it will be understood that the exemplary embodiments can be practiced utilizing either less than or more than the certain number of elements.

The invention claimed is:

1. A compression connector for an RF cable, the compression connector comprising:

a connector body having an inner surface;

a threaded clamp configured to translate within the connector body;

a contact cone having an outer surface that engages with the inner surface of the connector body;

an insulator disposed within the connector body, the insulator having a disk shape and an outer surface that engages with the inner surface of the connector body, and a rear face that engages with a forward face of the contact cone, the insulator further having an aperture disposed at the center of the disk shape; and a two-piece inner conductor, the two-piece inner conductor having an interface component and a contact component, wherein the contact component has a passive inner conductor basket and a cylindrical portion disposed within the aperture of the insulator, and wherein the interface component has an opening that engages with the cylindrical portion of the contact component, and wherein the two-piece inner conductor forms one or more slots that are configured to hold the two-piece inner conductor in rigid contact with the insulator.

2. The compression connector of claim 1, wherein the threaded clamp is configured to engage with a corrugated outer conductor of the RF cable and thereby apply pressure against the contact cone, causing the contact cone to make rigid contact with the insulator.

3. The compression connector of claim 1, wherein the one or more slots are defined on the inner conductor basket comprises a plurality of saw cuts.

4. The compression connector of claim 1, wherein the interface component engages with the cylindrical portion of the contact component via a press fit contact.

5. The compression connector of claim 1, wherein an air gap is defined between the contact component and the contact cone.

6. The compression connector of claim 1, further comprising an overmolded strain relief component disposed on a portion of the connector body and a portion of an outer surface of the RF cable.

7. The compression connector of claim 6, further comprising a WPS boot disposed over the connector body, wherein the WPS boot forms a seal with the connector body and the overmolded strain relief component.

8. The compression connector of claim 1, further comprising an overmolded strain relief component positioned on a portion of the connector body and a portion of an outer surface of the cable.

9. The compression connector of claim 8, further comprising a weather protection boot positioned over the connector body and configured to form a seal with the connector body and the overmolded strain relief component.

10. The compression connector of claim 1, wherein the contact cone is configured to engage an outer conductor of the cable.

11. The compression connector of claim 1, wherein the connector body comprises a first end configured to couple to a port and an opposing second end configured to receive a portion of the cable, wherein threaded clamp is positioned towards the second end of the body and the two-piece inner conductor is positioned toward the first end of the body.

12. The compression connector of claim 8, wherein the contact cone is configured to engage an outer conductor of the cable.

13. The compression connector of claim 8, wherein the second end of the body is configured to receive a portion of the cable.

14. A compression connector comprising:

a connector body having a first end and an opposing second end and comprising an inner surface;

a threaded clamp located proximate the second end and at least partially positioned within the connector body, wherein the threaded clamp is configured to slide relative to the connector body;

a contact cone positioned within the connector body in a direction towards the first end relative to the threaded clamp, wherein the contact cone comprises an outer surface configured to engage with the inner surface of the connector body;

an insulator positioned proximate the contact cone and defining an aperture, wherein the insulator is configured to contact the inner surface of the connector body; and an inner conductor comprising, a contact component comprising an inner conductor basket and a cylindrical portion extending from the conductor basket that is at least partially positioned within the aperture of the insulator, and an interface component defining an opening configured to engage with the cylindrical portion of the contact component, wherein when a cable is installed at the second end of the connector body, the contact component, the interface component, and the insulator are held together such that they form a rigid three-piece assembly.

15. The compression connector of claim 14, wherein the threaded clamp is configured to engage with a corrugated outer conductor of the cable and thereby apply pressure against the contact cone to cause the contact cone to make rigid contact with the insulator.

16. The compression connector of claim 14, wherein the inner conductor basket comprises one or more slots.

17. The compression connector of claim 14, wherein the interface component engages the cylindrical portion of the contact component via a press fit contact.

18. The compression connector of claim 14, wherein an air gap is defined between the contact component and the contact cone.

19. The compression connector of claim 18, wherein the inner conductor basket is positioned in the air gap.

* * * * *